US012686548B2

(12) United States Patent
Uthoff

(10) Patent No.: US 12,686,548 B2
(45) Date of Patent: Jul. 21, 2026

(54) DUAL POUCH WITH TEAR-AWAY LABEL

(71) Applicant: KELLANOVA, Battle Creek, MI (US)

(72) Inventor: Andrew Carl Uthoff, Caledonia, MI (US)

(73) Assignee: KELLANOVA, Battle Creek, MI (US)

( * ) Notice: Subject to any disclaimer, the term of this patent is extended or adjusted under 35 U.S.C. 154(b) by 87 days.

(21) Appl. No.: 18/861,009

(22) PCT Filed: Apr. 27, 2023

(86) PCT No.: PCT/US2023/020153
§ 371 (c)(1),
(2) Date: Oct. 28, 2024

(87) PCT Pub. No.: WO2023/212163
PCT Pub. Date: Nov. 2, 2023

(65) Prior Publication Data

US 2025/0340350 A1 Nov. 6, 2025

Related U.S. Application Data

(60) Provisional application No. 63/363,819, filed on Apr. 29, 2022.

(51) Int. Cl.
*B65D 75/58* (2006.01)

(52) U.S. Cl.
CPC ..... *B65D 75/5827* (2013.01)

(58) Field of Classification Search
CPC ..... B65D 75/5827; B65D 75/58
(Continued)

(56) References Cited

U.S. PATENT DOCUMENTS 3,217,934 A * 11/1965 Schneider ..... B65D 75/52 383/88
3,224,640 A * 12/1965 Schneider ..... B65D 31/12 383/88

(Continued)

FOREIGN PATENT DOCUMENTS

DE 202014103637 U1 8/2014
EP 1477089 A1 11/2004

(Continued)

OTHER PUBLICATIONS

PCT/US2023/020153 International Search Report dated Nov. 7, 2023.

*Primary Examiner* — Peter N Helvey
(74) *Attorney, Agent, or Firm* — Honigman LLP

(57) ABSTRACT

A food package includes first and second pouches and a retaining sheet that removably secures the second pouch at an outer surface of the first pouch. The first pouch includes an opening element that provides access to the first pouch when a user performs an opening action on the first pouch. The retaining sheet includes a first portion adhered along an upper region of the first pouch, a second portion adhered along a lower region of the first pouch, and a third portion between the first and second portions that engages the second pouch to secure the second pouch between the retaining sheet and the first pouch. A perforated region connects the first and third portions and is configured to separate the third portion from the first portion when the user performs the opening action to at least partially release the second pouch from the first pouch.

20 Claims, 9 Drawing Sheets

(58) Field of Classification Search
USPC ..... 383/37, 200
See application file for complete search history.

(56) References Cited

U.S. PATENT DOCUMENTS 3,291,374 A * 12/1966 Lepisto ..... B65D 31/04 D9/705
5,102,234 A * 4/1992 Levy ..... B65D 31/12 383/38
5,407,277 A * 4/1995 Burke ..... B65D 31/12 206/459.1
5,411,168 A * 5/1995 Mertens ..... B42D 5/005 221/33
6,012,844 A * 1/2000 Huseman ..... B65D 33/20 383/93
2002/0014433 A1* 2/2002 Schneider ..... B65D 31/12 383/93
2008/0107781 A1* 5/2008 Carroll ..... B65D 31/12 426/106
2011/0158565 A1* 6/2011 Hellming ..... B65D 31/12 383/203
2013/0114916 A1* 5/2013 Gray ..... B65F 1/067 383/61.4
2016/0143457 A1* 5/2016 Tan ..... A47F 9/042 211/59.2
2016/0174303 A1* 6/2016 Werner ..... B65D 11/16 383/207
2016/0192802 A1* 7/2016 Alipour ..... A47J 27/10 383/37
2023/0202729 A1* 6/2023 Montpart Sanchez ..... B65B 7/2878 383/37
2023/0264879 A1* 8/2023 Michael ..... B65D 75/522 383/200

FOREIGN PATENT DOCUMENTS

JP 2015-63337 A 4/2015
KR 200469613 Y1 10/2013

* cited by examiner

DUAL POUCH WITH TEAR-AWAY LABEL

CROSS-REFERENCE TO RELATED APPLICATIONS

This application is a National Stage Application and claims priority under 35 U.S.C. § 371 to Patent Cooperation Treaty application PCT/US2023/020153, filed Apr. 27, 2023, which claims the benefit under 35 U.S.C. § 119 (a) and (e) of and priority to U.S. Provisional Application 63/363,819 filed on Apr. 29, 2022. Priority is claimed to each of these applications and the disclosures of these prior applications are considered part of the disclosure of this application, and to the extent allowed, the entire contents of the aforementioned applications are incorporated herein.

TECHNICAL FIELD

This disclosure relates to multi-pouch food packaging with one or more secondary pouches secured to a primary pouch via a tear-away label.

BACKGROUND

It is known to package food and other consumable items in a pouch or bag, such as a gusseted pouch configured to stand or rest vertically upon a horizontal surface (such as a grocery store shelf). It is also known to assemble two or more pouches together in a single package, such as providing pouches holding related items in a shared box or bag. However, known means for packaging multiple pouches together often rely on secondary packaging materials (i.e., larger boxes or bags) that increase costs and overall footprint of the assembled package.

SUMMARY

One aspect of the disclosure provides a food package. The food package includes a first pouch defining a first compartment and including an opening element configured to provide access to the first compartment when a user performs an opening action on the first pouch. The food package further includes a second pouch defining a second compartment. A retaining sheet removably secures the second pouch at an outer surface of the first pouch. The retaining sheet includes a first portion adhered to the outer surface of the first pouch along an upper region of the first pouch. A second portion of the retaining sheet is adhered to the outer surface of the first pouch along a lower region of the first pouch. A third portion of the retaining sheet is disposed between the first portion and the second portion and engages the second pouch to secure the second pouch between the retaining sheet and the outer surface of the first pouch. A first perforated region of the retaining sheet connects the first portion and the third portion. The first perforated region is configured to separate the third portion of the retaining sheet from the first portion when the user performs the opening action to at least partially release the second pouch from the outer surface of the first pouch.

Implementations of the disclosure may include one or more of the following optional features. In some implementations, the retaining sheet includes a second perforated region connecting the third portion and the second portion. The second perforated region is configured to separate the third portion of the retaining sheet from the second portion. In some embodiments, the first perforated region includes a plurality of perforated lines spanning a width of the retaining sheet. In some examples, a guide notch is formed along an edge of the retaining sheet to guide separation of the third portion of the retaining sheet from the first portion along the first perforated region when the user performs the opening action.

In some implementations, the first perforated region includes a plurality of non-continuous perforation segments across a width of the retaining sheet. In further implementations, each perforation segment of the plurality of non-continuous perforation segments includes a horizontal portion extending along the retaining sheet substantially parallel to the width of the retaining sheet, and an angled portion extending from an end of a respective horizontal portion at an obtuse angle relative to the horizontal portion.

In some embodiments, the opening element includes a notch along a peripheral edge of the first pouch at the upper region of the first pouch. In those embodiments, the opening action includes tearing the first pouch from the notch and along a tear line of the first pouch across the upper region of the first pouch. The tear line corresponds to the first perforated region so that tearing the first pouch along the tear line separates the third portion of the retaining sheet from the first portion.

In some examples, the retaining sheet is adhered to an outer surface of the second pouch. In some implementations, the retaining sheet includes a cutout region and a portion of the second pouch is exposed at the cutout region. In further implementations, the portion of the second pouch exposed at the cutout region includes a notch for opening the second pouch to access the second compartment. In some embodiments, the first compartment holds a first foodstuff and the second compartment holds a second foodstuff different from the first foodstuff.

Another aspect of the disclosure provides a food package. The food package includes a first pouch defining a first compartment and including an opening element configured to provide access to the first compartment when a user performs an opening action on the first pouch. The food package further includes a second pouch defining a second compartment. A retaining sheet removably secures the second pouch at an outer surface of the first pouch. The retaining sheet includes a first portion adhered to the outer surface of the first pouch along an upper region of the first pouch. A second portion of the retaining sheet is adhered to the outer surface of the first pouch along a lower region of the first pouch. A third portion of the retaining sheet is disposed between the first portion and the second portion and engages the second pouch to secure the second pouch between the retaining sheet and the outer surface of the first pouch. The retaining sheet further includes a cutout region and a portion of the second pouch is exposed at the cutout region. A first perforated region of the retaining sheet includes a plurality of non-continuous perforation segments across a width of the retaining sheet. The first perforated region connects the first portion and the third portion and is configured to separate the third portion of the retaining sheet from the first portion when the user performs the opening action to at least partially release the second pouch from the outer surface of the first pouch.

Implementations of the disclosure may include one or more of the following optional features. In some implementations, the retaining sheet includes a second perforated region connecting the third portion and the second portion. The second perforated region is configured to separate the third portion of the retaining sheet from the second portion. In some embodiments, a guide notch is formed along an edge of the retaining sheet to guide separation of the third portion of the retaining sheet from the first portion along the first perforated region when the user performs the opening action. In some examples, each perforation segment of the plurality of perforation segments includes a horizontal portion extending along the retaining sheet substantially parallel to the width of the retaining sheet, and an angled portion extending from an end of a respective horizontal portion at an obtuse angle relative to the horizontal portion.

In some implementations, the opening element includes a notch along a peripheral edge of the first pouch at the upper region of the first pouch. In those implementations, the opening action includes tearing the first pouch from the notch and along a tear line of the first pouch across the upper region of the first pouch. The tear line corresponds to the first perforated region so that tearing the first pouch along the tear line separates the third portion of the retaining sheet from the first portion.

In some embodiments, the retaining sheet is adhered to an outer surface of the second pouch. In some examples, the portion of the second pouch exposed at the cutout region includes a notch for opening the second pouch to access the second compartment. In some implementations, the first compartment holds a first foodstuff and the second compartment holds a second foodstuff different from the first foodstuff.

Yet another aspect of the present disclosure provides a method of opening a food package. The method includes providing a food package. The food package includes a first pouch defining a first compartment and including a notch along a peripheral edge at an upper region of the first pouch. The food package further includes a second pouch defining a second compartment. A retaining sheet removably secures the second pouch at an outer surface of the first pouch. The retaining sheet includes a first portion adhered to the outer surface of the first pouch along the upper region of the first pouch. A second portion of the retaining sheet is adhered to the outer surface of the first pouch along a lower region of the first pouch. A third portion of the retaining sheet is disposed between the first portion and the second portion and engages the second pouch to secure the second pouch between the retaining sheet and the outer surface of the first pouch. A first perforated region of the retaining sheet connects the first portion and the second portion. The method includes tearing the first pouch from the notch and along a tear line of the first pouch across the upper region of the first pouch. Tearing the first pouch opens the first pouch to provide access to the first compartment. The method further includes, while tearing the first pouch along the tear line, separating the third portion of the retaining sheet from the first portion of the retaining sheet along the first perforated region to at least partially release the second pouch from the outer surface of the first pouch.

Implementations of the disclosure may include one or more of the following optional features. In some implementations, the retaining sheet includes a second perforated region connecting the third portion and the first portion. In those implementations, the method includes, after separating the third portion of the retaining sheet from the first portion of the retaining sheet, separating the third portion of the retaining sheet from the second portion of the retaining sheet along the second perforated region to release the second pouch from the outer surface of the first pouch.

In some embodiments, the first perforated region includes a plurality of perforated lines spanning a width of the retaining sheet. In some examples, a guide notch is formed along an edge of the retaining sheet to guide separation of the third portion of the retaining sheet from the first portion along the first perforated region during tearing of the first pouch.

In some implementations, the first perforated region includes a plurality of non-continuous perforation segments across a width of the retaining sheet. In further implementations, each perforation segment of the plurality of non-continuous perforation segments includes a horizontal portion extending along the retaining sheet substantially parallel to the width of the retaining sheet, and an angled portion extending from an end of a respective horizontal portion at an obtuse angle relative to the horizontal portion.

In some embodiments, the retaining sheet includes a cutout region, and a portion of the second pouch is exposed at the cutout region. In further embodiments, the method includes, after the second pouch is released from the outer surface of the first pouch, tearing the second pouch via a notch disposed at the portion of the second pouch exposed at the cutout region to access the second compartment. In some examples, the first compartment holds a first foodstuff and the second compartment holds a second foodstuff different from the first foodstuff.

The details of one or more implementations of the disclosure are set forth in the accompanying drawings and the description below. Other aspects, features, and advantages will be apparent from the description and drawings, and from the claims.

DESCRIPTION OF DRAWINGS

The drawings described herein are for illustrative purposes only of selected configurations and not all possible implementations, and are not intended to limit the scope of the present disclosure.

Like reference symbols in the various drawings indicate like elements.

DETAILED DESCRIPTION

Figure 1A:
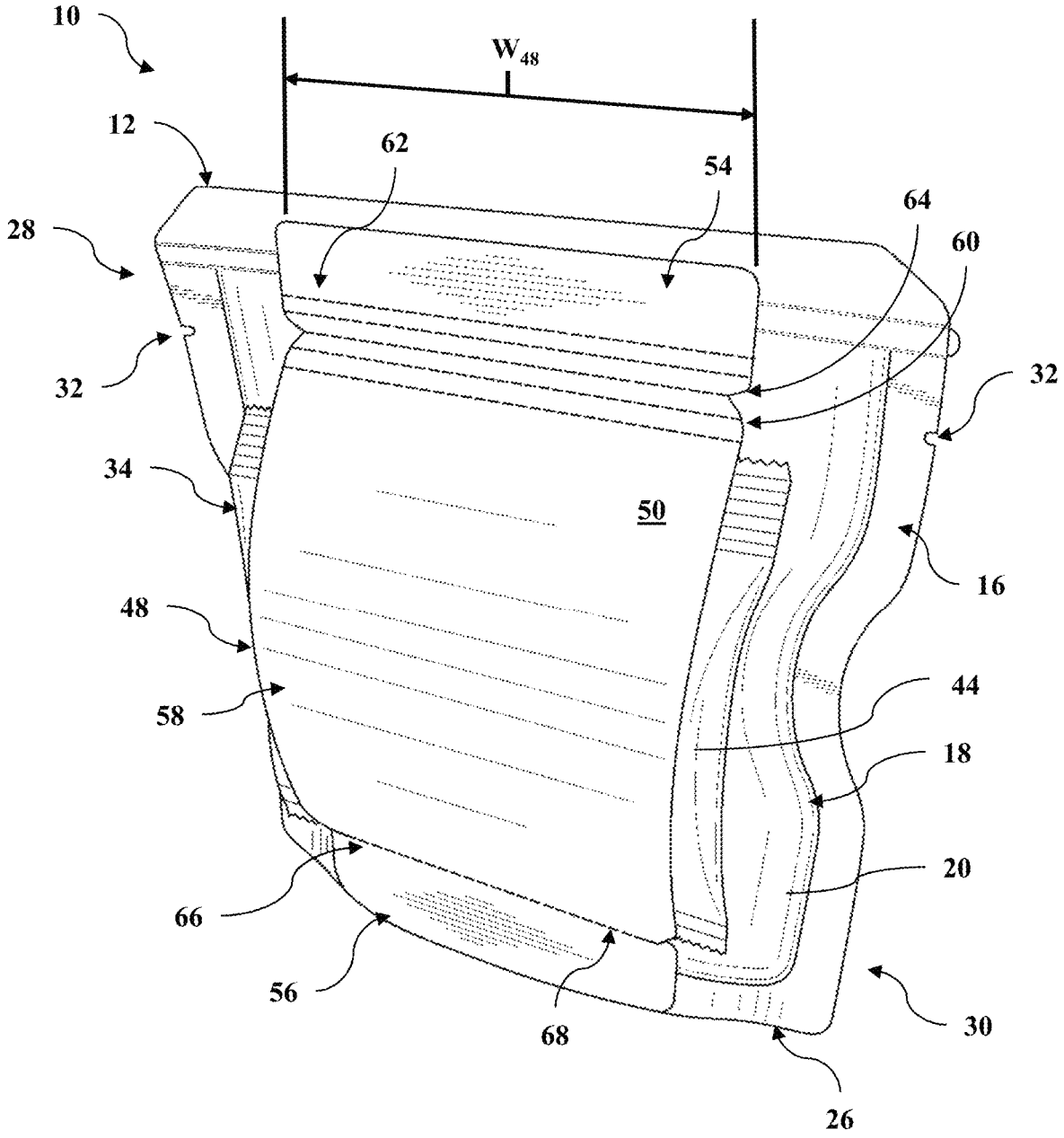
FIG. 1A is a perspective view of a food package including a primary pouch and a secondary pouch secured to the primary pouch via an adhesive retaining sheet.

Pouches, such as pillow bags and gusseted pouches, are a cost effective and efficient means of packaging food and other consumable items. Such pouches generally form a compartment surrounded by one or more perimeter seals, with the food or other item contained within the compartment and protected from environmental contaminants (such as germs, bugs, dirt, and the like) via the one or more perimeter seals. Gusseted packaging, when not loaded with one or more products, is typically designed to collapse into a thin, space-efficient structure and is generally expandable when filled with product so that a relatively large volume of products may be packaged using a relatively small amount of packaging material. For example, a gusseted pouch may have collapsible sidewalls or barriers that expand outwards as front and rear surfaces or barriers are forced or pushed away from one another as the product fills the compartment defined by the barriers. Pillow bags, when not loaded with product, are also typically designed to collapse into substantially two-dimensional structures, where the body of the pillow bag is expandable to accommodate the volume of product.

It is often desirable to package one or more pouches together, so that pouches containing different products or multiple pouches containing the same product may be provided together as a unit. For example, a primary or first pouch may contain a first product and a secondary or second pouch may contain a second product that is intended to be combined and consumed with the first product. In one instance, the primary pouch may contain an entree or primary foodstuff and the secondary pouch may contain a flavoring or additive foodstuff intended to be added to the entree prior to consuming. The additive may be kept separate from the entree to preserve freshness of the entree or to enable selective packing of different additives with different entrees.

However, traditional methods of packaging one or more pouches together may result in excessive use of materials and a larger overall footprint of the product, leading to higher materials and storage costs. For example, common techniques may require secondary packaging materials, such as larger bags or boxes that hold the one or more pouches. Additionally, traditional methods of assembling one or more pouches into a combined package may either form too weak of a connection between multiple pouches (resulting in unintentional separation of the pouches during transport) or too strong of a connection (making it difficult for the user to separate the pouches when ready to consume).

Thus, an aspect of the present disclosure is to provide a food package that provides a primary pouch and one or more secondary pouches attached to the primary pouch via an adhesive label or retaining sheet, where the retaining sheet is configured to release the secondary pouch simultaneously with opening of the primary pouch. The retaining sheet is adhered to an outer surface of the primary pouch and secures the secondary pouch between the retaining sheet and the outer surface of the primary pouch. The retaining sheet includes a perforated region aligned with a tear line of the primary pouch so that, when the primary pouch is opened along the tear line, the tearing action of opening the primary pouch separates the retaining sheet along the perforations, releasing at least a portion of the retaining sheet from the outer surface of the primary pouch. Releasing the portion of the retaining sheet from the outer surface at least partially releases the secondary pouch from the primary pouch. The secondary pouch can then be opened and the contents of the primary and secondary pouches can be accessed by the user.

Attaching the secondary pouch at the outer surface of the primary pouch via the adhesive label or retaining sheet provides a compact packaging design that requires minimal use of packaging materials. For example, the primary pouch may be a gusseted pouch configured to, when filled with product, stand vertically upon a horizontal surface (such as a grocery store shelf) on a base of the gusseted pouch. The secondary pouch may be a suitable size to attach to the primary gusseted pouch without tipping or otherwise affecting the balance of the primary pouch. Thus, the combined package can stand vertically on a horizontal surface without the use of additional materials, such as a box or peg board. As described herein, a "vertical orientation" refers to a front surface and a rear surface of the primary pouch standing upright relative to a horizontal support surface such that the front surface may form a front-facing portion and the rear surface may form a rear-facing portion of the primary pouch. In contrast, a "horizontal orientation" refers to one of the front surface or rear surface laying on the support surface.

Furthermore, the retaining sheet with the one or more perforated regions provides a reliable securing means that enables easy and intentional separation of the primary and secondary pouches by a user while precluding unintentional separation, such as during transport. The perforated region is configured to separate at least a portion of the retaining sheet from the outer surface of the primary pouch when the primary pouch is opened. When the retaining sheet is at least partially separated from the primary pouch, the secondary pouch may be released.

Additionally, attaching the secondary pouch at the outer surface of the primary pouch allows both the primary and secondary pouches to be visible when displayed on the horizontal surface. The retaining sheet may have a printed outer surface, such that the retaining sheet may be printed with labels, graphics, or wordmarks, such as nutritional information, product branding, or other information regarding the contents of the pouches. The retaining sheet may include a window or a cutout portion that exposes or provides visibility to a portion of the secondary pouch, allowing a viewer to see the secondary pouch retained at the front surface of the primary pouch.

Referring now to the drawings and the illustrated embodiments shown therein, a food package 10 includes a primary pouch 12, a secondary pouch 34, and a retaining sheet 48 (FIG. 1A). The retaining sheet 48 removably secures the secondary pouch 34 at an outer surface of the primary pouch 12 and is configured to release the secondary pouch 34 from the primary pouch 12 when a user opens the primary pouch 12.

The first or primary pouch 12 defines a first compartment 14 that holds a first product, such as a foodstuff or other consumable item. The first compartment 14 is defined by a perimeter seal 16 that forms an outer edge of the primary pouch 12. In the illustrated embodiment, the primary pouch 12 is a gusseted pouch having a first barrier sheet 18 defining a front or first surface 20 of the pouch 12 and a second barrier sheet 22 defining a rear or second surface 24 of the pouch, with an expandable base 26 extending between and separating the barrier sheets 18, 22 at a lower end of the pouch 12. The first barrier sheet 18 and the second barrier sheet 22 are joined along the continuous perimeter seal 16 such as to provide a unitary outer edge of the pouch 12. The perimeter seal 16 may join the first barrier sheet 18 and the second barrier sheet 22 along opposing sides of the pouch 12 and at an upper edge of an upper region 28 of the pouch 12, while the base 26 may join with the barrier sheets 18, 22 to form a lower edge or portion of the perimeter seal 16 at a lower region 30 of the pouch 12. Optionally, the base 26 may be integrally formed with one or both of the first barrier sheet 18 and the second barrier sheet 22. The primary pouch 12 is configured to expand when the first compartment 14 is filled with product such that the primary pouch 12 stands vertically when resting on a horizontal support surface upon the base 26, such as shown in FIG. 1A.

An opening element 32 is disposed at the upper region 28 of the primary pouch 12 for providing access to the compartment 14 of the pouch 12 when the user performs an opening action on the pouch 12. As will be discussed below, the opening element 32 may include any suitable element and is configured such that when the user performs the opening action to open the primary pouch 12, the opening action at least partially detaches the retaining sheet 48 from the primary pouch 12 to at least partially release the secondary pouch 34 from the primary pouch. For example, the opening element 32 may be a resealable opening element 32, such as a self-sealing or zipper-sealing opening along the first barrier sheet 18, or the opening element 32 may be a single-use opening element 32, such as a pull-tab. In the illustrated embodiment, the opening element 32 includes one or more notches 32 along the perimeter seal 16 at opposing sides of the upper region 28 of the primary pouch 12. Thus, the opening action may require the user to tear the primary pouch 12 from one notch 32 and along the upper region 28 across the pouch 12 toward the other notch 32.

The second or secondary pouch 34 is secured to the outer or front surface 20 of the primary pouch 12 via the retaining sheet 48. The secondary pouch 34 defines a second compartment 36 that holds a second product, such as a second foodstuff or other consumable item. The secondary pouch 34 may be smaller than the primary pouch 12 so that the secondary pouch 34 can be secured to the front surface 20 of the primary pouch 12 without significantly affecting the ability of the assembled package 10 to stand upright. In other words, the dimensions of the secondary pouch 34 are configured such that, when filled with the second product, the weight of the secondary pouch 34 will not topple the package 10 and the size of the secondary pouch 34 is configured such that it will not interfere with the base 26 of the primary pouch 12 resting on the horizontal surface.

In the illustrated embodiment, the secondary pouch 34 is a pillow bag having a first or upper seal 40, a second or lower seal 42, and the body or bag 38 of the pouch 34 between the upper seal 40 and the lower seal 42 defines the second compartment 36. The secondary pouch 34 includes a first surface 44 that engages the retaining sheet 48 and a second surface 46 that engages the first surface 20 of the primary pouch 12 when the secondary pouch 34 is retained between the retaining sheet 48 and the primary pouch 12. The upper seal 40 and/or the lower seal 42 may be configured to be tearable by a user to open the secondary pouch 34 to access the second compartment 36 after the secondary pouch 34 is released from the primary pouch 12.

The secondary pouch 34 is removably secured to the outer surface 20 of the primary pouch 12 via the retaining sheet 48 such that the secondary pouch 34 is held between the outer surface 20 of the primary pouch 12 and the retaining sheet 48. As shown, the retaining sheet 48 is a thin, rectangular sheet or band having opposing end portions 54, 56 attached or adhered to the outer surface 20 of the primary pouch 12, whereby an intermediate portion 58 of the retaining sheet 48 between the opposing ends is spaced from the primary pouch 12 to accommodate the secondary pouch 34 disposed thereat. Thus, the retaining sheet 48 has a first or outer surface 50 that is visible when the retaining sheet 48 is attached at the primary pouch 12, and a second or inner surface 52 that engages the secondary pouch 34 and is opposite the outer surface 50.

A first or upper portion 54 of the retaining sheet 48 is attached or adhered to the first surface 20 of the primary pouch 12 along the upper region 28 of the pouch 12 and a lower portion 56 of the retaining sheet 48 is attached or adhered to the first surface 20 of the primary pouch 12 along the lower region 30 of the pouch 12. The upper portion 54 and the lower portion 56 (and thus the upper edge and lower edge) of the retaining sheet 48 may be adhered to the primary pouch 12 in any suitable manner, such as via an adhesive element or material disposed between the retaining sheet 48 and the primary pouch 12. Optionally, the retaining sheet 48 may include the adhesive element, such as a glue or paste or tape, at the second surface 52 to adhere the retaining sheet 48 to the primary pouch. Optionally, the upper portion 54 and/or the lower portion 56 may be integrally formed with the first barrier sheet 18 of the primary pouch 12 such that the retaining sheet 48 is formed with and extends from the first surface 20.

A second or middle or intermediate portion 58 of the retaining sheet 48 is disposed between the upper portion 54 and the lower portion 56 and engages the secondary pouch 34 to secure the secondary pouch 34 between the retaining sheet 48 and the primary pouch 12. A first or upper perforated region 60 connects the upper portion 54 and the middle portion 58 of the retaining sheet 48 and is configured to separate the upper portion 54 and the middle portion 58 when releasing the secondary pouch 34 from the primary pouch 12. Thus, when the upper portion 54 and the middle portion 58 are separated along the first perforated region 60, the upper portion 54 may remain adhered to the upper region 28 of the primary pouch 12 and the middle portion 58 may release from the primary pouch 12 to release the retaining sheet 48 and secondary pouch 34 therefrom.

The first perforated region 60 includes an upper or first set of perforations 62 that span a width $W_{48}$ of the retaining sheet 48 along the first perforated region 60, whereby the first set of perforations 62 enable separation of the middle portion 58 from the upper portion 54. In the illustrated embodiment, the first set of perforations 62 are perforated lines 70, 70*a-n* (i.e., linear groupings of perforations at least partially through the retaining sheet 48 and spanning across the width $W_{48}$ of the retaining sheet) between the upper portion 54 and the middle portion 58. However, it should be understood that the first perforated region 60 may include any suitable means for releasing the upper portion 54 and the middle portion 58 when the user performs the opening action.

As shown, the first set of perforations 62 may include multiple parallel perforated lines 70 spaced from one another and spanning the width $W_{48}$ of the retaining sheet 48, such as a first perforated line 70*a*, a second perforated line 70*b*, a third perforated line 70*c*, a fourth perforated line 70*d*, and a fifth perforated line 70*e*. Thus, the first perforated region 60 may be formed along an upper portion of the middle portion 58 and a lower portion of the upper portion 54 such that the first perforated region 60 forms a boundary between the upper portion 54 and the middle portion 58 that is severable at multiple positions. When the retaining sheet 48 is separated along the first perforated region 60, the first set of perforations 62 may separate along one of the perforated lines 70 and thus one portion of the perforated region 60 will remain with the upper portion 54 and another portion of the perforated region 60 will remain with the middle portion 58.

Figure 2B:
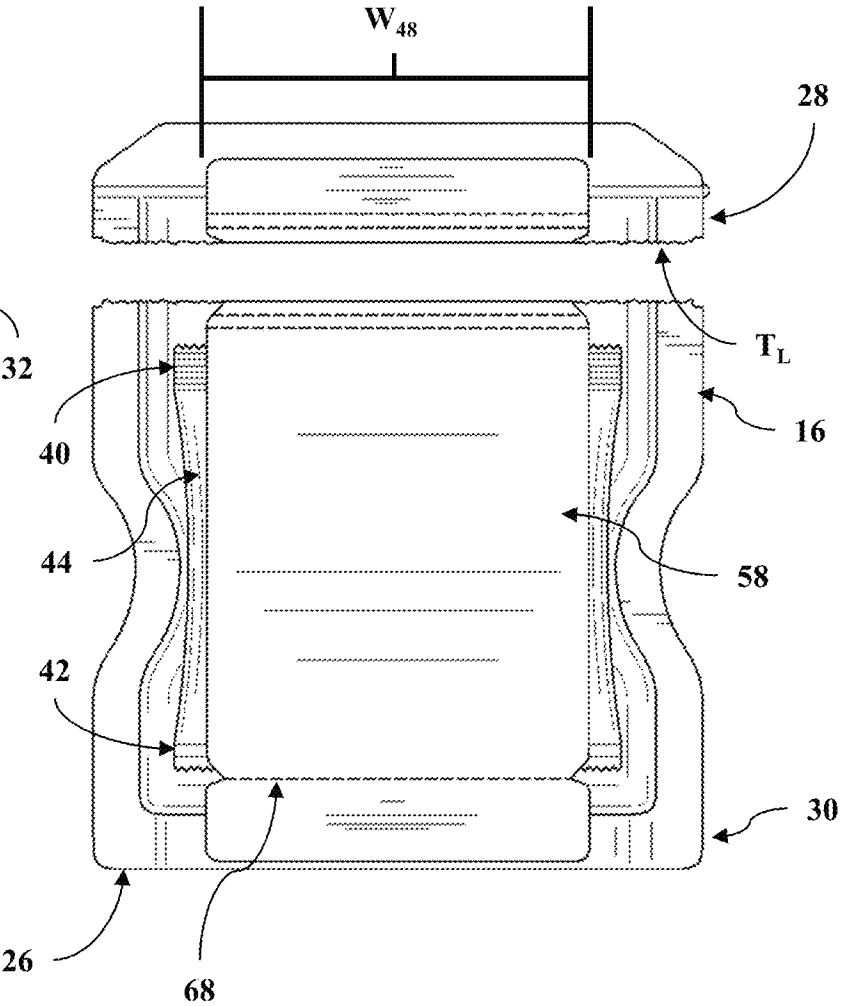
FIG. 2B is a front view of the food package of FIG. 1A with the retaining sheet partially detached from the primary pouch upon opening of the primary pouch.
Figure 2A:
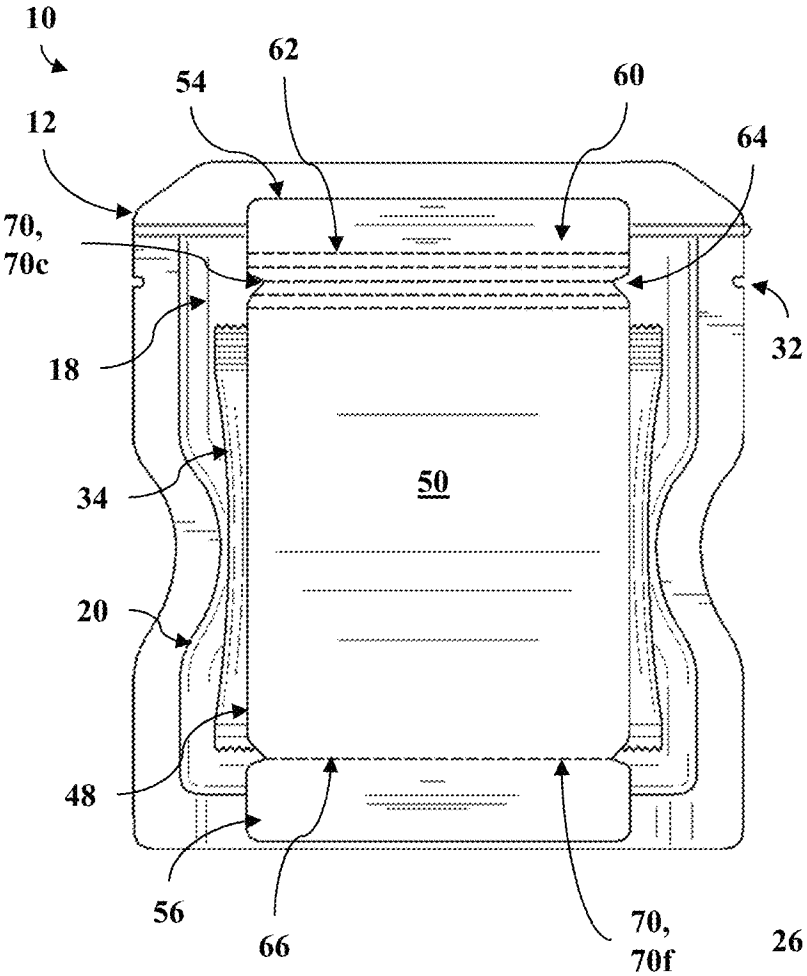
FIG. 2A is a front view of the food package of FIG. 1A.

When the user performs the opening action (i.e., tears the primary pouch 12), the tearing of the primary pouch 12 may form or follow a tear line $T_L$ along the upper region 28 of the primary pouch 12 and the tear line $T_L$ may correspond to the first perforated region 60 so that tearing the primary pouch 12 along the tear line $T_L$ also acts upon the first set of perforations 62 to release the upper portion 54 and the middle portion 58. For example, and as shown in FIG. 2A, the tear line $T_L$ may correspond with one or more of the perforated lines 70 of the first set of perforations 62 so that when the user tears the primary pouch 12 across the upper region 28 and between the notches 32, the tearing motion follows the first set of perforations 62 to release the middle portion 58 and the secondary pouch 34 from the primary pouch 12.

The parallel perforated lines 70, 70*a-n* are vertically spaced from one another along the first perforated region 60 to account for variability in the opening action when the user forms the tear line $T_L$ across the upper region 28 of the primary pouch 12. In other words, as the user performs the tearing action from one of the notches 32, the user may form a jagged or non-uniform tear line $T_L$ across the upper region 28 of the primary pouch 12. Spacing the parallel perforated lines 70, 70*a-n* relative to one another ensures that the jagged or non-uniform tear line $T_L$ aligns with or corresponds to or engages at least one of the perforated lines 70, 70*a-n* during the opening action to separate the upper portion 54 and middle portion 58 of the retaining sheet 48 along the respective perforated line 70.

Figure 1B:
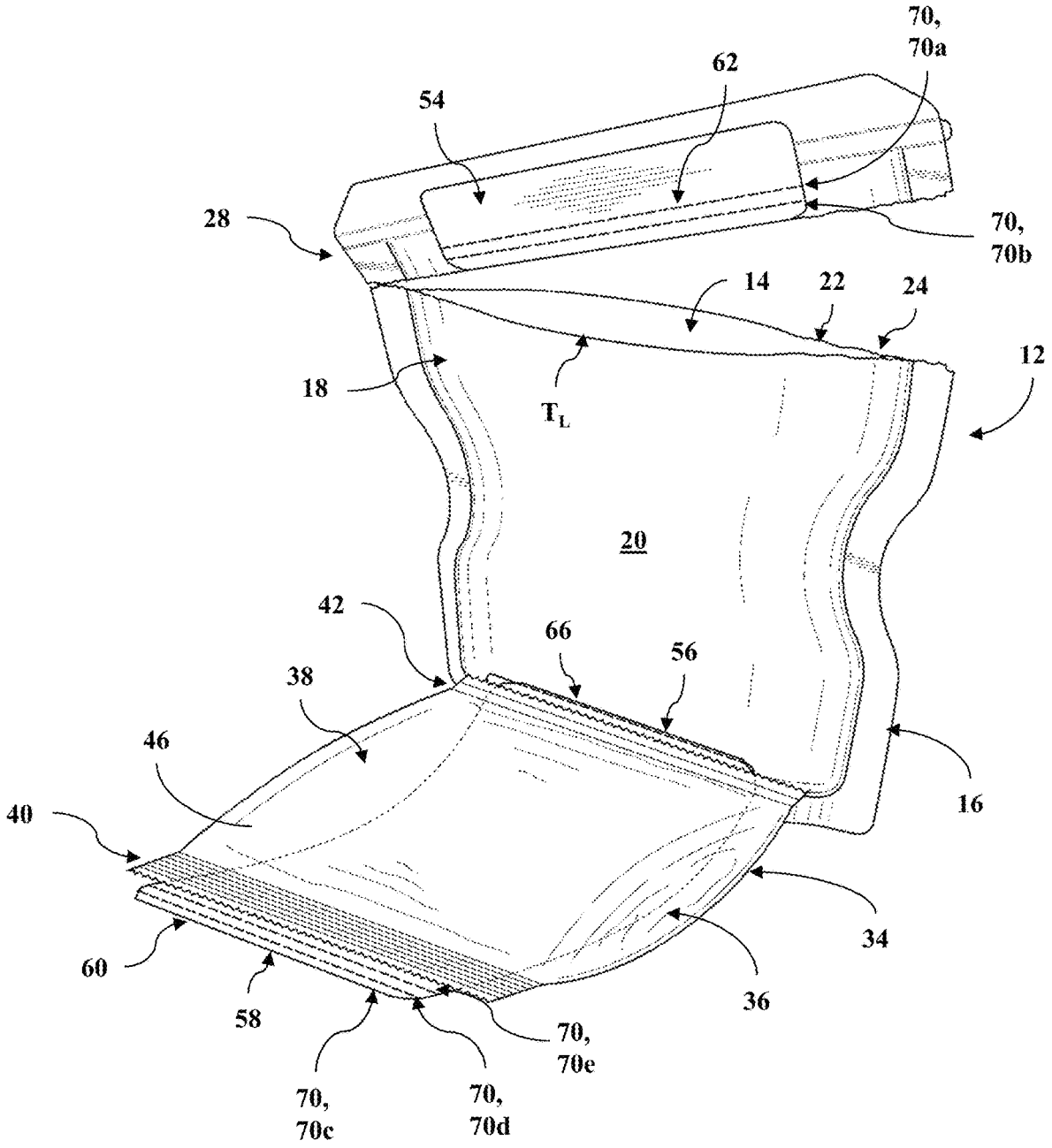
FIG. 1B is a perspective view of the food package of FIG. 1A with the retaining sheet partially detached from the primary pouch upon opening of the primary pouch.
Figure 1C:
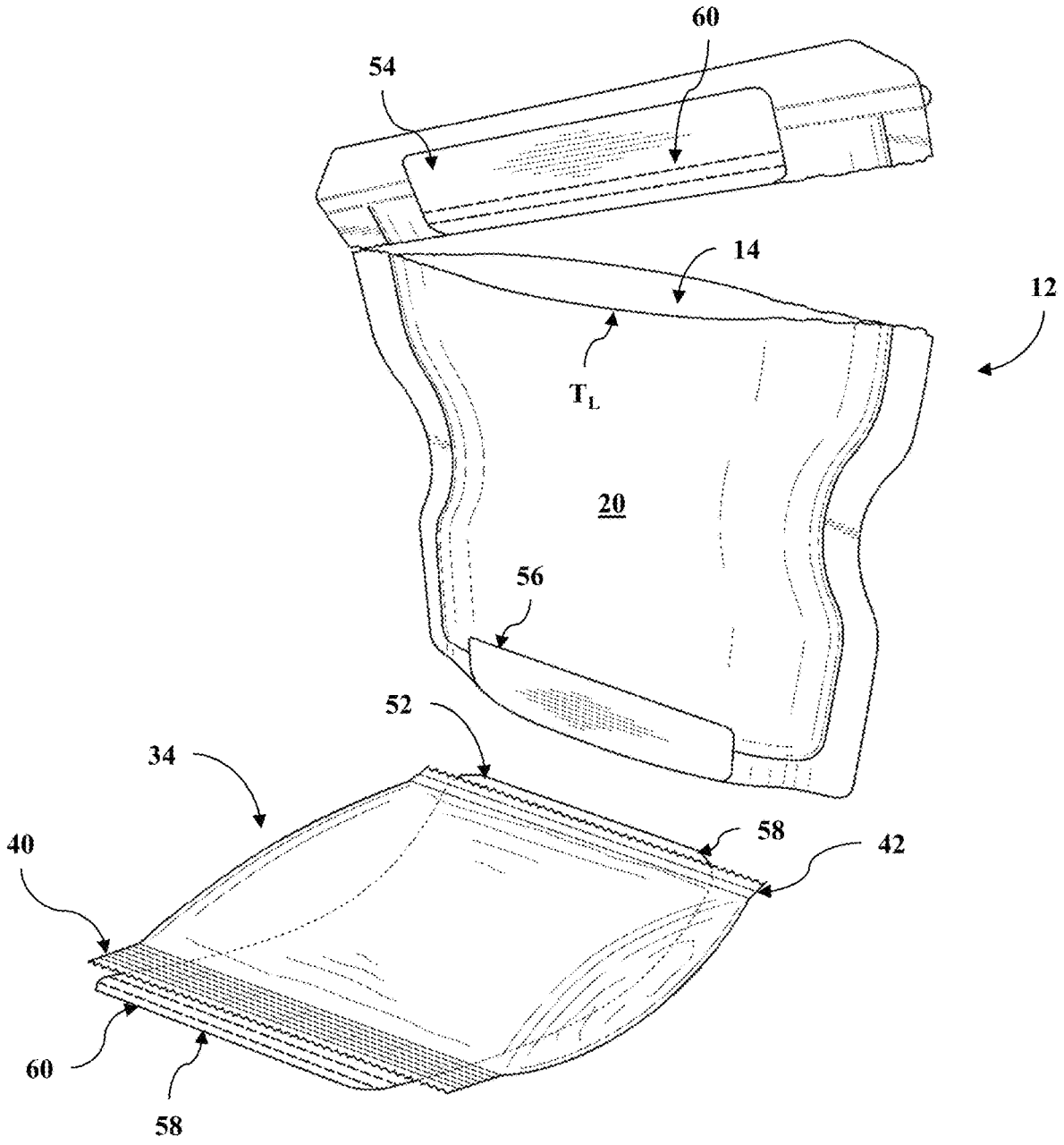
FIG. 1C is a perspective view of the food package of FIG. 1A with the retaining sheet fully removed from the primary pouch to release the secondary pouch.

The retaining sheet 48 and/or the primary pouch 12 may include a guide element 64 to guide or direct the opening action of the user along the first perforated region 60. For example, the primary pouch 12 may be printed with an indicator (e.g., a dotted line or other graphic) directing the user to tear the primary pouch 12 at a position that corresponds with the first perforated region 60. In the illustrated embodiment, a guide notch 64 is formed along an edge of the retaining sheet 48 to guide the tear line TL along the first perforated region 60. Thus, the guide notch 64 guides separation of the middle portion 58 from the upper portion 54 along the first perforated region 60 when the user performs the opening action. For example, as shown in FIGS. 1B, 1C, and 2B, the guide notch 64 aligns with the third perforated line 70*c* and thus the first perforated region 60 separates along the third perforated line 70*c* when the tearing motion follows the tear line $T_L$ across the upper region 28 of the primary pouch 12. Optionally, the primary pouch 12 may include perforations that align with the first set of perforations 62 of the retaining sheet 48 to further guide the tear line $T_L$.

As shown in FIGS. 1B and 1C, the retaining sheet 48 includes a second perforated region 66 connecting the middle portion 58 and the lower portion 56. The second perforated region 66 is configured to separate the middle portion 58 of the retaining sheet 48 from the lower portion 56, such as upon a secondary tearing motion by the user. Thus, the user may perform the opening action to open the primary pouch 12 and release the middle portion 58 from the upper portion 54 and subsequently separate the middle portion 58 and the lower portion 56 along the second perforated region 66 to fully release the middle portion 58 and secondary pouch 34 from the primary pouch 12. The second perforated region 66 may include any suitable separating means, such as a second set of perforations 68. For example, the second set of perforations 68 may include a sixth perforated line 70*f*, or a plurality of perforated lines.

To further secure the secondary pouch 34 between the retaining sheet 48 and the outer surface of the primary pouch 12, the secondary pouch 34 may be attached to or integrally formed with the middle portion 58 of the retaining sheet 48. For example, the front surface 44 of the secondary pouch 34 may be adhered to the second surface 52 of the retaining sheet 48. Thus, to fully release the secondary pouch 34 from the primary pouch 12, the retaining sheet 48 must be released from the upper region 28 and the lower region 30 of the primary pouch 12 (e.g., the first perforated region 60 and the second perforated region 66 must be separated respectively).

Although described herein as including a first perforated region 60 and a second perforated region 66 including respective perforations, the retaining sheet 48 may include any suitable severable element configured to retain and separate the middle portion 58 from the upper portion 54 and the lower portion 56. For example, the retaining sheet 48 may include adhesive strips or hook and loop fasteners that connect the respective portions and that allow the middle portion 58 to be reattached at the upper portion 54 and the lower portion 56. Optionally, the middle portion 58 may be removably attached to the upper portion 54 and the lower portion 56 via respective pull tabs that, when pulled by a user, release the middle portion 58 from the upper portion 54 and the lower portion 56.

Furthermore, although shown as a vertically standing pouch having a horizontally opening compartment that releases an upper portion of the retaining sheet and a middle portion of the retaining sheet, the primary pouch 12 may rest upon the base 26 in any suitable configuration relative to the opening element 32 and retaining sheet 48. For example, the retaining sheet 48 may be disposed horizontally along the front surface 20 of the primary pouch 12. Optionally, the retaining sheet 48 may be disposed along a top surface of a container, such as a box having a top surface and an opening element along the top surface of the box. In other words, the relative orientation of the elements described herein, such as the upper portion 54, middle portion 58, and lower portion 56 of the retaining sheet 48, are provided merely to aid in the understanding of the disclosure and should be understood to not be intentionally limiting of the disclosure provided.

Optionally, the opening element 32 may have any suitable configuration for providing access to the compartment 14 of the primary pouch 12 and separating the retaining sheet 48 to release the secondary pouch 34. For example, the opening element 32 may be a resealable zipper opening that, when separated by a user, the opening action separates the first set of perforations 62 along the first perforated region 60.

As shown in FIGS. 3A-4B, a food package 110 includes a first or primary pouch 112, a second or secondary pouch 134, and a retaining sheet 148. The retaining sheet 148 removably secures the secondary pouch 134 at an outer surface of the primary pouch 112 and is configured to release the secondary pouch 134 from the primary pouch 112 when a user opens the primary pouch 112. Except as described below, the primary pouch 112 and the secondary pouch 134 are substantially similar to the primary pouch 12 and secondary pouch 34 described above, such that a full discussion of the primary pouch 112 and secondary pouch 134 is not needed to properly describe the food package 110. As such, it should be understood that the primary pouch 112 and the secondary pouch 134 may represent other suitable configurations of pouches having any of the optional characteristics described herein.

The retaining sheet 148 is similar to the retaining sheet 48 and includes an upper or first perforated region 160 including a first set of perforations 162 that include non-continuous perforation segments 172, 172*a-n* across a first width $W_{148a}$ of the retaining sheet 148 at the upper perforated region 160. While the perforation segments 172 are configured to separate the middle portion 158 and the upper portion 154 of the retaining sheet 148 during the opening action, the perforation segments 172 may be less susceptible to inadvertent separation than other separation means. For example, if an unintentional force were applied at an edge of the retaining sheet 148, such as if the retaining sheet 148 were caught or snagged on a surface during transport of the package 110, one of the perforation segments 172 may separate. However, because of the non-continuous or non-aligned nature of the perforation segments 172, additional force would be needed to continue the separation across the width $W_{148a}$ of the retaining sheet 148. In comparison, the perforated lines 70 represent a continuous line of perforations across the width $W_{48}$ of the retaining sheet 48 and thus require less force to completely separate the middle portion 58 and the upper portion 54 when the user performs the opening action.

The retaining sheet 148 further includes a tapered profile along at least one edge of the retaining sheet 148 such that a reduced-width or cutout region 178 exposes at least a portion of the secondary pouch 134 when the secondary pouch 134 is secured at the primary pouch 112. As discussed above, the secondary pouch 134 may be adhesively attached at the retaining sheet 148 so that, after the secondary pouch 134 is released from the primary pouch 112, the secondary pouch 134 may remain attached to the retaining sheet 148. The cutout region 178 exposes a portion of the secondary pouch 134 so that a user may open the secondary pouch 134 without separating the secondary pouch 134 from the retaining sheet 148. For example, the cutout region 178 may align with or expose a tear point along the upper seal 140 and/or lower seal 142 of the secondary pouch 134 to allow a user to open the secondary pouch 134 via the exposed tear point. In the illustrated embodiment, the tapered profile of the cutout region 178 is configured to guide tearing of the secondary pouch 134 so that a tear line following the edge of the cutout region 178 forms a spout-shaped opening in the secondary pouch 134.

The retaining sheet 148 removably secures the secondary pouch 134 at a first or outer or front surface 120 of the primary pouch 112, such that the secondary pouch 134 is secured between the outer surface 120 and the retaining sheet 148. The retaining sheet 148 includes an upper portion 154, a lower portion 156, and a middle portion 158 disposed between the upper portion 154 and the lower portion 156. The upper portion 154 is attached or adhered to the first surface 120 of the primary pouch 112 along the upper region 128 of the primary pouch 112. The lower portion 156 is attached or adhered to the first surface 120 of the primary pouch 112 along the lower region 130 of the primary pouch 112. The middle portion 158 engages the secondary pouch 134 to retain the secondary pouch 134 between the retaining sheet 148 and the first surface 120 of the primary pouch 112.

The first perforated region 160 connects the upper portion 154 and the middle portion 158 and is configured to separate the middle portion 158 of the retaining sheet 148 from the upper portion 154 when the user performs the opening action to at least partially release the secondary pouch 134 from the primary pouch 112. As discussed above, the first perforated region 160 includes a first set of perforations 162 and the first set of perforations 162 include non-continuous perforation segments 172 across the width $W_{148a}$ of the retaining sheet at the first perforated region 160. In the illustrated embodiment, each of the perforation segments 172 includes a horizontal portion 174 and an angled portion 176. Each horizontal portion 174 originates remote from another perforation segment 172 and extends for a short distance along the retaining sheet 148 and substantially parallel to the width $W_{148a}$ of the retaining sheet 148. The angled portions 176 extend from an end of a respective horizontal portion 174 at an angle, such as an obtuse angle, relative to the horizontal portion 174 and terminates remote from other perforation segments 172.

A pattern of horizontal rows 173 of perforation segments 172 may span a lower portion of the upper portion 154 and an upper portion of the middle portion 158 of the retaining sheet 148 so that the tear line $T_{L2}$ may follow any combination of perforation segments 172 across the retaining sheet 148 during the opening action. The perforation segments 172 are positioned along the first perforated region 160 in an alternating and offset alignment to reduce inadvertent separation of the perforation segments 172. That is, horizontal rows 173 of perforation segment 172 are vertically spaced from one another across the width W148*a* of the retaining sheet 148 and the individual perforation segments 172 of each horizontal row 173 are horizontally offset from the corresponding perforation segments 172 of the proximal horizontal row 173 so that an inadvertent separating force is unlikely to separate adjacent perforation segments 172.

Yet, the perforation segments 172 are configured to properly separate responsive to a user performing an opening action and forming the tear line $T_{L2}$ along the upper region 128 of the primary pouch 112. As shown, respective horizontal portions 174 of the perforation segments 172 of each horizontal row 173 are positioned proximal to the respective edges of the retaining sheet 148 to receive the initial force of the opening action. Each perforation segment 172 of a respective horizontal row 173 is facing in the same direction (i.e., the horizontal portion 174 is on the left or right of the respective angled portion 176). Further, the perforation segments 172 of adjacent horizontal rows 173 face in opposite directions so that the angled portions 176 of the perforation segments 172 in one horizontal row 173 are positioned proximal to angled portions 172 of adjacent perforation segments 172 in an adjacent horizontal row 173. As such, the angled portions 174 direct the tearing force along the perforation segments 172 across the first perforated region 160. Additionally, because the horizontal rows 173 of perforation segments 172 have opposite facing patterns, the first perforated region 160 is configured to receive a tearing motion from either notch 132 and thus accommodates tearing motions in both directions across the upper region 128 of the primary pouch 112.

Figure 3A:
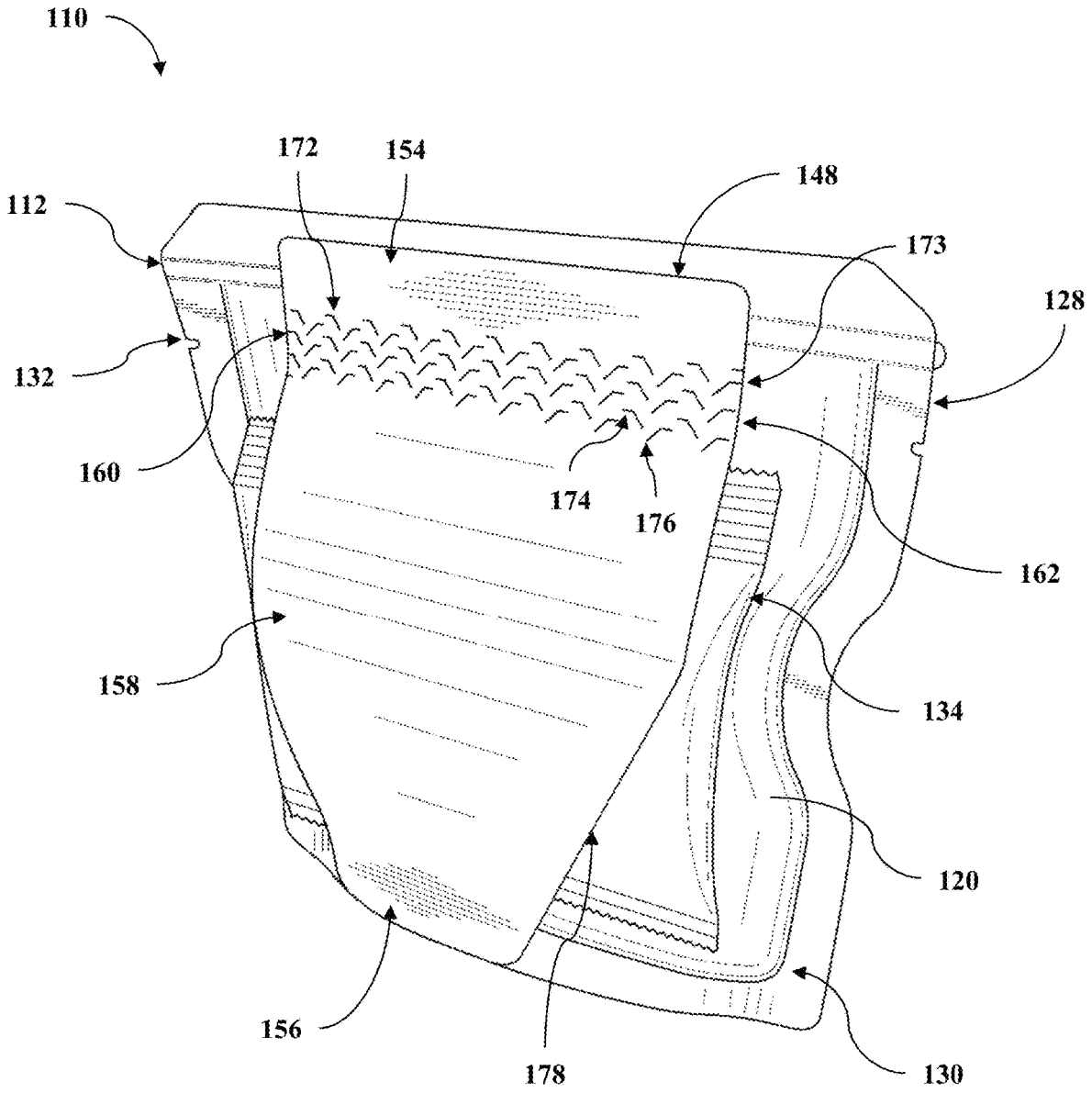
FIG. 3A is a perspective view of another food package including a primary pouch, a secondary pouch, and an adhesive retaining sheet having a plurality of non-continuous perforation segments and a cutout region.
Figure 3B:
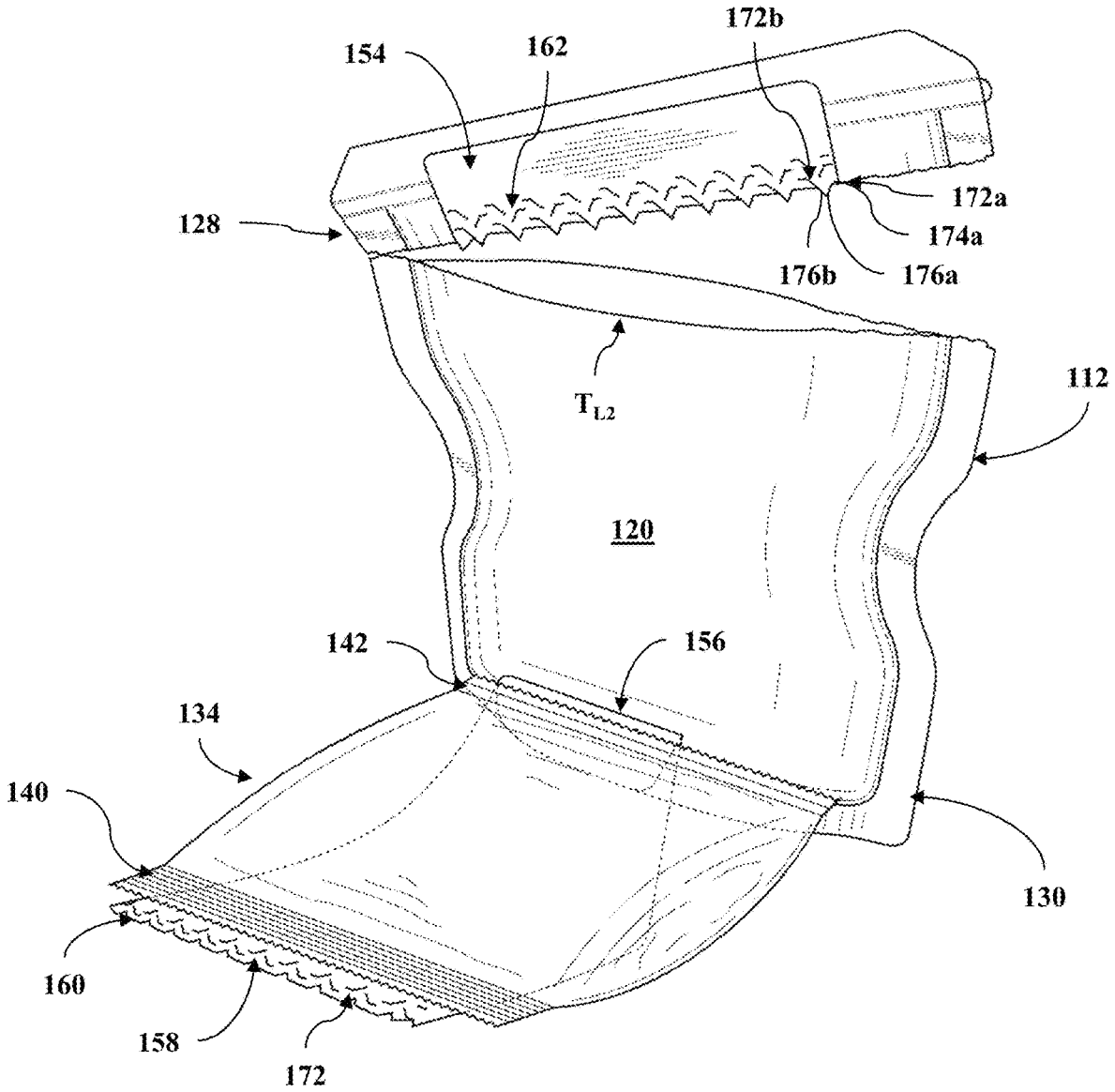
FIG. 3B is a perspective view of the food package of FIG. 3A with the retaining sheet partially detached from the primary pouch upon opening of the primary pouch.
Figure 3C:
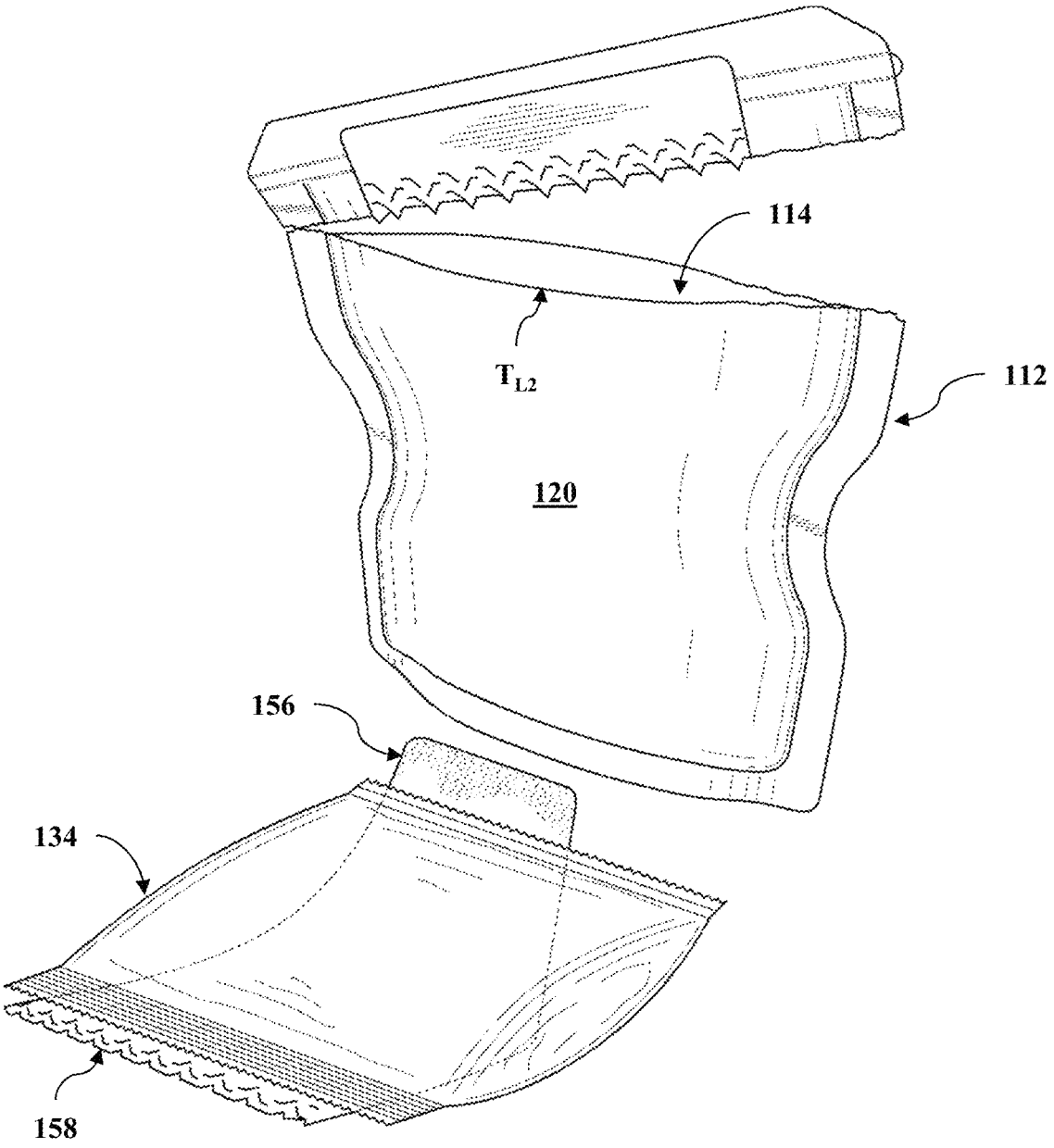
FIG. 3C is a perspective view of the food package of FIG. 3A with the retaining sheet fully removed from the primary pouch to release the secondary pouch.
Figure 4B:
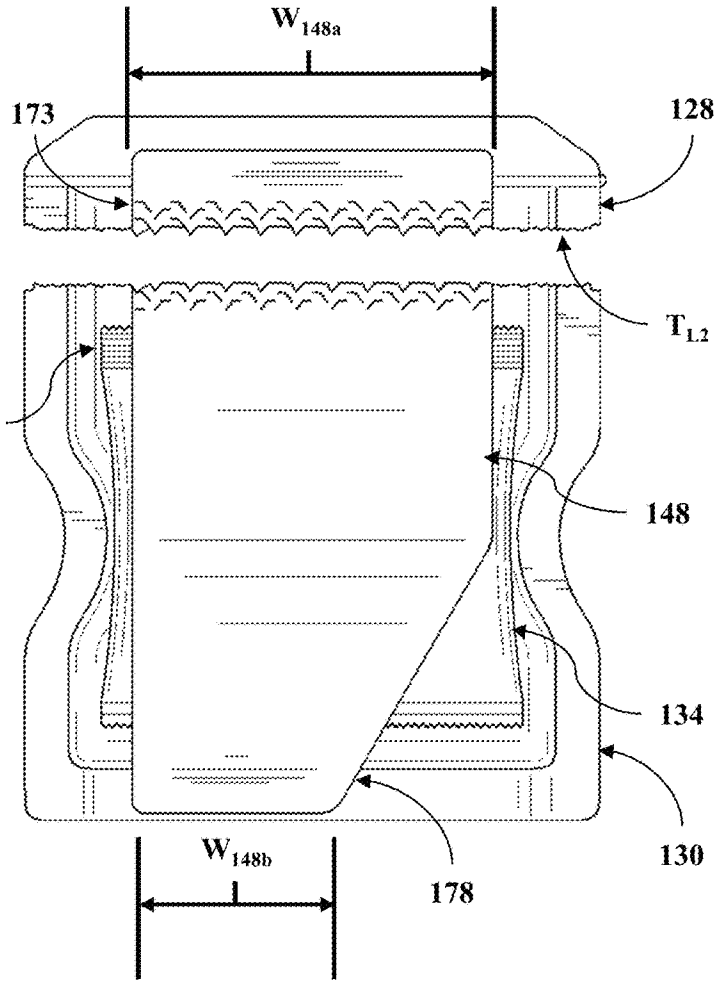
FIG. 4B is a front view of the food package of FIG. 1A with the retaining sheet partially detached from the primary pouch upon opening of the primary pouch.
Figure 4A:
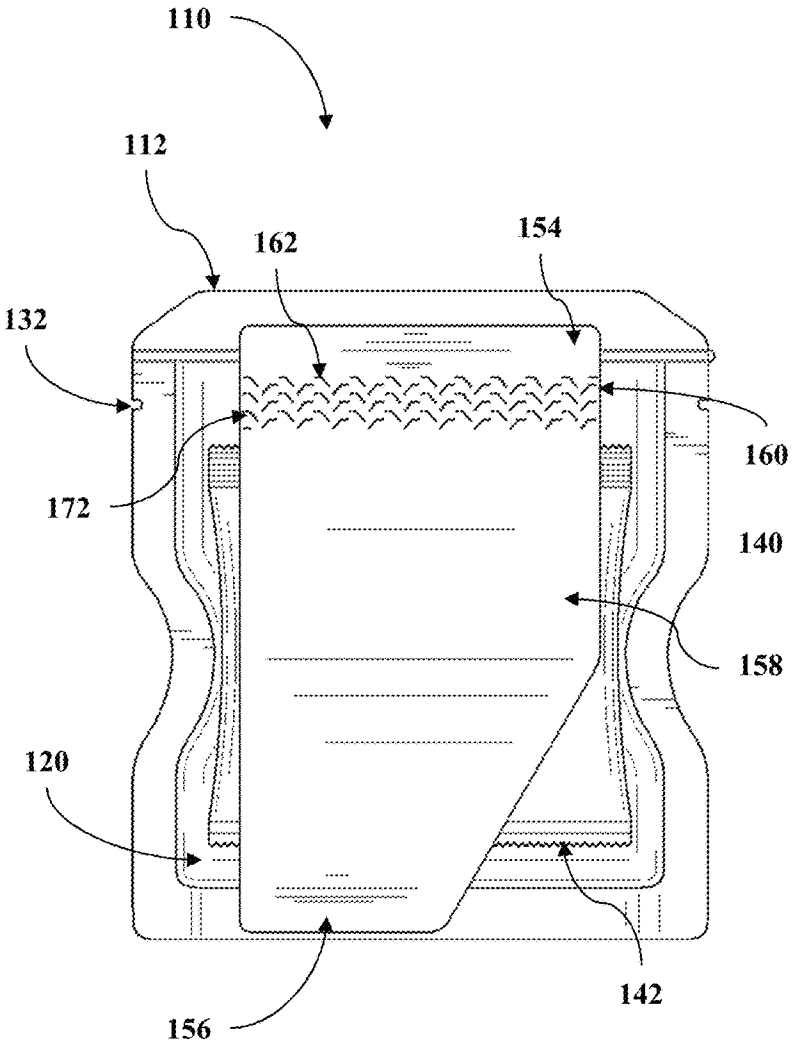
FIG. 4A is a front view of the food package of FIG. 3A.

Thus, and as shown in FIGS. 3B, 3C, and 4B, when the user performs the opening action and tears the primary pouch 112 between the notches 132, the tearing motion follows or forms a tear line $T_{L2}$ along the upper region 128 of the primary pouch 112 and the first perforated region 160 of the retaining sheet 148. Due to the nature of the perforation segments 172, the tear line $T_{L2}$ along the retaining sheet 148 may form a jagged separated edge of the retaining sheet 148 between the upper portion 154 and the middle portion 158. The tear line $T_{L2}$ may follow or be guided between individual perforation segments 172 of the first set of perforations 162. For example, a first perforation segment 172*a* may be proximal to the edge of the retaining sheet 148 where the tear line $T_{L2}$ intersects the retaining sheet 148 such that the horizontal portion 174*a* of the first perforation segment 172*a* separates along the tear line $T_{L2}$, followed by the angled portion 176*a* of the first perforation segment 172*a*. The tear line $T_{L2}$ may then separate the material of the retaining sheet 148 between the angled portion 176*a* of the first perforation segment 172*a* and the angled portion 176*b* of a second perforation segment 172*b* proximal to the first perforation segment 172*a* and subsequently follow a path between perforation segments 172 across the width $W_{148a}$ of the retaining sheet 148. Although shown in the illustrated embodiment as forming a substantially horizontal pattern along the first perforated region 160, the opening action may release the middle portion 158 from the upper portion 154 along any suitable connection of perforation segments 172.

As shown in FIG. 3C, the lower portion 156 of the retaining sheet 148 may be removable from the outer surface 120 of the primary pouch 112 with the middle portion 158 when the secondary pouch 134 is fully released from the primary pouch 112. In other words, the lower portion 156 and the middle portion 158 may not be separable. Thus, when the secondary pouch 134 is adhered to the retaining sheet 148, the lower portion 156 of the retaining sheet 148 is removed from the outer surface 120 of the primary pouch 112 to release the secondary pouch 134. For example, the lower portion 156 may be adhered to the primary pouch 112 and the user may peel the lower portion 156 from the primary pouch to release the secondary pouch 134.

As discussed above, and such as shown in FIGS. 4A and 4B, the retaining sheet 148 includes the cutout region 178 exposing a portion of the secondary pouch 134 so that, when the secondary pouch 134 is adhered to the retaining sheet 148, the user may open the secondary pouch 134 at the cutout region 178 without removing the retaining sheet 148 from the secondary pouch 134. In the illustrated embodiment, the cutout region 178 is defined by a tapered profile of the retaining sheet 148 where the width of the retaining sheet 148 narrows between a first width $W_{148a}$ and a second width $W_{148b}$ from the middle portion 158 towards the lower edge of the lower portion 156 of the retaining sheet 148. Thus, the cutout region 178 exposes a portion of the lower seal 142 of the secondary pouch 134 to allow a user to open the secondary pouch 134 along the lower seal 142.

Figure 5:
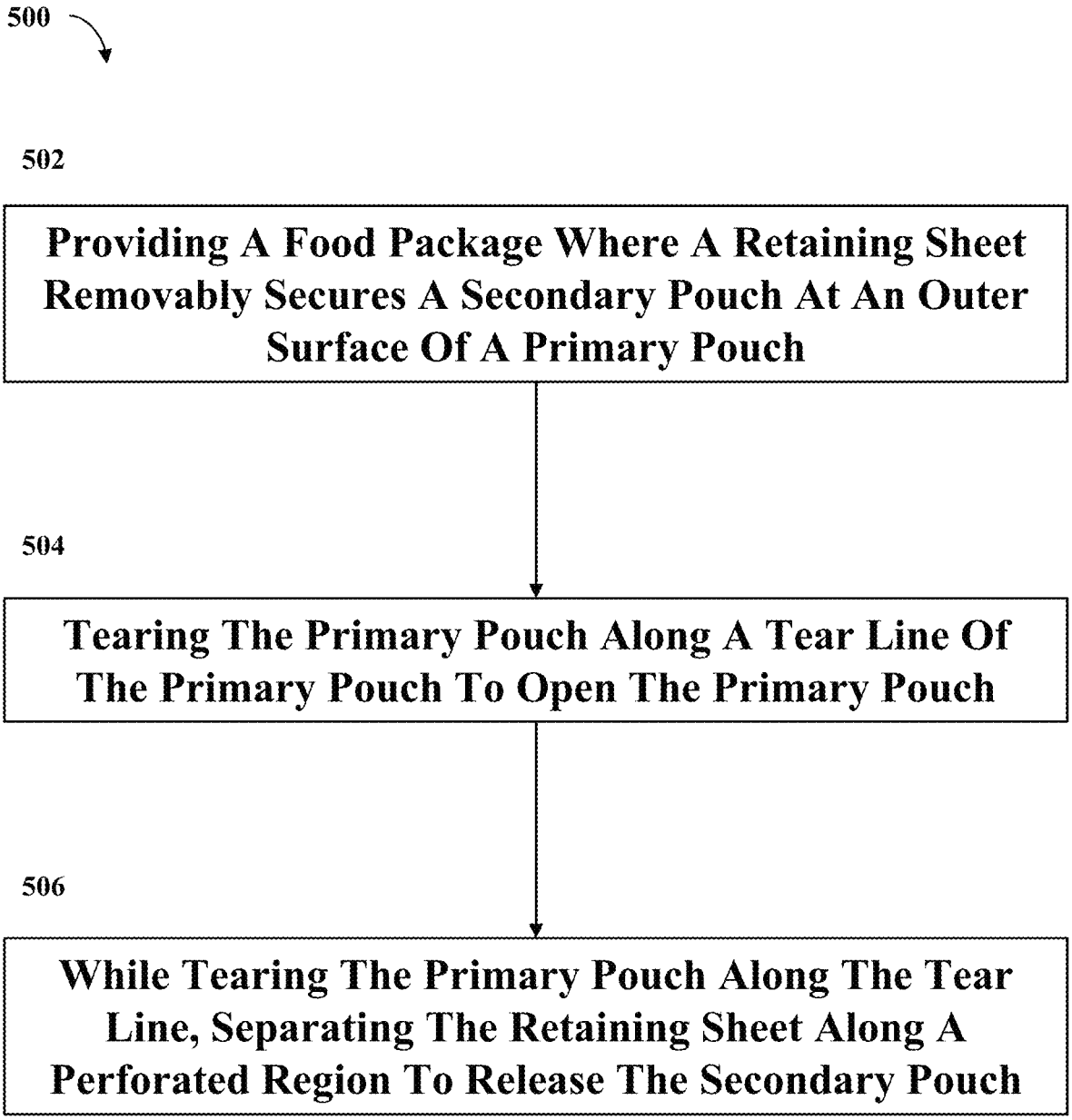
FIG. 5 is a flow diagram showing a method of opening a food package having a primary pouch, a secondary pouch, and a retaining sheet securing the secondary pouch to an outer surface of the primary pouch.

FIG. 5 is an example of a method 500 of opening a food package 10, 110. At operation 502, the method 500 includes providing a food package 10, 110 as described herein. At operation 504, the method 500 includes tearing the first pouch 12, 112 from the notch 32, 132 and along a tear line $T_L$ of the first pouch 12, 112 across the upper region 28, 128 of the first pouch 12, 112. Tearing the first pouch 12, 112 opens the first pouch 12, 112 to provide access to the first compartment 14, 114. At operation 506, the method 500 includes, while tearing the first pouch 12, 112 along the tear line $T_L$, separating the middle portion 58, 158 of the retaining sheet 48, 148 from the upper portion 54, 154 of the retaining sheet 48, 148 along the first perforated region 60, 160 to at least partially release the second pouch 34, 134 from the outer surface 20, 120 of the first pouch 12, 112.

Thus the present disclosure provides a food package that includes a first or primary pouch and a second or secondary pouch removably secured at an outer surface of the primary pouch via an adhesive retaining sheet having a perforated region. When a user performs an opening action to access the compartment of the primary pouch, the opening action separates the retaining sheet to release the secondary pouch from the primary pouch. The food package therefore provides a means for packaging two or more separately packaged items together as a single unit with minimal additional packaging materials that may be easily separated by a user, but not easily separated by inadvertent forces acting upon the package. The food package provides an attractive and intuitive design that reduces packaging and storage costs when compared with traditional methods of packaging multiple separately packaged items together.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

A number of implementations have been described. Nevertheless, it will be understood that various modifications may be made without departing from the spirit and scope of the disclosure. Accordingly, other implementations are within the scope of the following claims.

What is claimed is:

1. A food package comprising:

a first pouch defining a first compartment and including an opening element configured to provide access to the first compartment when a user performs an opening action on the first pouch;

a second pouch defining a second compartment; and a retaining sheet that removably secures the second pouch at an outer surface of the first pouch, the retaining sheet comprising:

a first portion adhered to the outer surface of the first pouch along an upper region of the first pouch;

a second portion adhered to the outer surface of the first pouch along a lower region of the first pouch;

a third portion disposed between the first portion and the second portion that engages the second pouch to secure the second pouch between the retaining sheet and the outer surface of the first pouch; and a first perforated region connecting the first portion and the third portion, the first perforated region configured to separate the third portion of the retaining sheet from the first portion when the user performs the opening action to at least partially release the second pouch from the outer surface of the first pouch.

2. The food package of claim 1, wherein the retaining sheet comprises a second perforated region connecting the third portion and the second portion, the second perforated region configured to separate the third portion of the retaining sheet from the second portion.

3. The food package of claim 1, wherein the first perforated region comprises a plurality of perforated lines spanning a width of the retaining sheet.

4. The food package of claim 1, wherein a guide notch is formed along an edge of the retaining sheet to guide separation of the third portion of the retaining sheet from the first portion along the first perforated region when the user performs the opening action.

5. The food package of claim 1, wherein the first perforated region comprises a plurality of non-continuous perforation segments across a width of the retaining sheet.

6. The food package of claim 5, wherein each perforation segment of the plurality of non-continuous perforation segments comprises (i) a horizontal portion extending along the retaining sheet substantially parallel to the width of the retaining sheet, and (ii) an angled portion extending from an end of a respective horizontal portion at an obtuse angle relative to the horizontal portion.

7. The food package of claim 1, wherein the opening element comprises a notch along a peripheral edge of the first pouch at the upper region of the first pouch, and wherein the opening action comprises tearing the first pouch from the notch and along a tear line of the first pouch across the upper region of the first pouch, the tear line corresponding to the first perforated region so that tearing the first pouch along the tear line separates the third portion of the retaining sheet from the first portion.

8. The food package of claim 1, wherein the retaining sheet is adhered to an outer surface of the second pouch.

9. The food package of claim 1, wherein the retaining sheet comprises a cutout region, and wherein a portion of the second pouch is exposed at the cutout region.

10. The food package of claim 9, wherein the portion of the second pouch exposed at the cutout region comprises a notch for opening the second pouch to access the second compartment.

11. The food package of claim 1, wherein the first compartment holds a first foodstuff and the second compartment holds a second foodstuff different from the first foodstuff.

12. A method of opening a food package, the method comprising:

providing a food package, the food package comprising:

a first pouch defining a first compartment and including a notch along a peripheral edge at an upper region of the first pouch;

a second pouch defining a second compartment; and a retaining sheet that removably secures the second pouch at an outer surface of the first pouch, the retaining sheet comprising:

a first portion adhered to the outer surface of the first pouch along the upper region of the first pouch;

a second portion adhered to the outer surface of the first pouch along a lower region of the first pouch;

a third portion disposed between the first portion and the second portion that engages the second pouch to secure the second pouch between the retaining sheet and the outer surface of the first pouch; and a first perforated region connecting the first portion and the third portion;

tearing the first pouch from the notch and along a tear line of the first pouch across the upper region of the first pouch, whereby tearing the first pouch opens the first pouch to provide access to the first compartment; and while tearing the first pouch along the tear line, separating the third portion of the retaining sheet from the first portion of the retaining sheet along the first perforated region to at least partially release the second pouch from the outer surface of the first pouch.

13. The method of claim 12, wherein:

the retaining sheet comprises a second perforated region connecting the third portion and the first portion; and the method comprises, after separating the third portion of the retaining sheet from the first portion of the retaining sheet, separating the third portion of the retaining sheet from the second portion of the retaining sheet along the second perforated region to release the second pouch from the outer surface of the first pouch.

14. The method of claim 12, wherein the first perforated region comprises a plurality of perforated lines spanning a width of the retaining sheet.

15. The method of claim 12, wherein a guide notch is formed along an edge of the retaining sheet to guide separation of the third portion of the retaining sheet from the first portion along the first perforated region during tearing of the first pouch.

16. The method of claim 12, wherein the first perforated region comprises a plurality of non-continuous perforation segments across a width of the retaining sheet.

17. The method of claim 16, wherein each perforation segment of the plurality of non-continuous perforation segments comprises (i) a horizontal portion extending along the retaining sheet substantially parallel to the width of the retaining sheet, and (ii) an angled portion extending from an end of a respective horizontal portion at an obtuse angle relative to the horizontal portion.

18. The method of claim 12, wherein the retaining sheet comprises a cutout region, and wherein a portion of the second pouch is exposed at the cutout region.

19. The method of claim 18, wherein the method comprises, after the second pouch is released from the outer surface of the first pouch, tearing the second pouch via a notch disposed at the portion of the second pouch exposed at the cutout region to access the second compartment.

20. The method of claim 12, wherein the first compartment holds a first foodstuff and the second compartment holds a second foodstuff different from the first foodstuff.

* * * * *